US005282376A

United States Patent [19]

Steele et al.

[11] Patent Number: 5,282,376

[45] Date of Patent: Feb. 1, 1994

[54] METHOD AND APPARATUS FOR LUBRICATING METAL STRIP WITH AN OIL-WATER EMULSION

[75] Inventors: Anthony A. Steele, Nr. Sheffield; Andrew M. Pye, Sheffield, both of England

[73] Assignee: Davy McKee (Sheffield) Limited, Sheffield, United Kingdom

[21] Appl. No.: 856,911

[22] PCT Filed: Nov. 15, 1990

[86] PCT No.: PCT/GB90/01760

§ 371 Date: Jun. 10, 1992

§ 102(e) Date: Jun. 10, 1992

[87] PCT Pub. No.: WO91/07241

PCT Pub. Date: May 30, 1991

[30] Foreign Application Priority Data

Nov. 15, 1989 [GB] United Kingdom ..... 8925856

[51] Int. Cl.[5] ..... B21B 45/02

[52] U.S. Cl. ..... 72/43; 72/41

[58] Field of Search ..... 72/41, 42, 43, 44, 45, 72/201

[56] References Cited

U.S. PATENT DOCUMENTS

| | | | |
|---|---|---|---|
| 2,310,563 | 2/1943 | Wilke et al. . | |
| 2,401,340 | 6/1946 | Dunmire et al. | 72/42 |
| 3,709,012 | 1/1973 | Larsonneur | 72/43 |
| 4,315,421 | 2/1982 | Wilson | 72/42 |
| 5,090,225 | 2/1992 | Schimion | 72/42 |

FOREIGN PATENT DOCUMENTS

| | | | |
|---|---|---|---|
| 3835460 | 4/1990 | Fed. Rep. of Germany . | |
| 2101197 | 3/1972 | France . | |
| 0041010 | 4/1981 | Japan | 72/43 |
| 0202905 | 12/1982 | Japan | 72/45 |
| 0719723 | 3/1980 | U.S.S.R. | 72/45 |
| 0759163 | 8/1980 | U.S.S.R. | 72/45 |
| 0956083 | 9/1982 | U.S.S.R. | 72/43 |
| 1297882 | 11/1972 | United Kingdom . | |

*Primary Examiner*—Daniel C. Crane
*Assistant Examiner*—Michael J. McKeon
*Attorney, Agent, or Firm*—Lee, Mann, Smith, McWilliams, Sweeney & Ohlson

[57] ABSTRACT

When rolling metal strip, an emulsion of rolling oil and water is applied to opposite surfaces of the strip. A measured flow of rolling oil is introduced into a measured flow of water to cause at least partial mixing and then it is subjected to turbulence to produce emulsion immediately prior to it being applied to the strip.

10 Claims, 2 Drawing Sheets

METHOD AND APPARATUS FOR LUBRICATING METAL STRIP WITH AN OIL-WATER EMULSION

Figure 1:
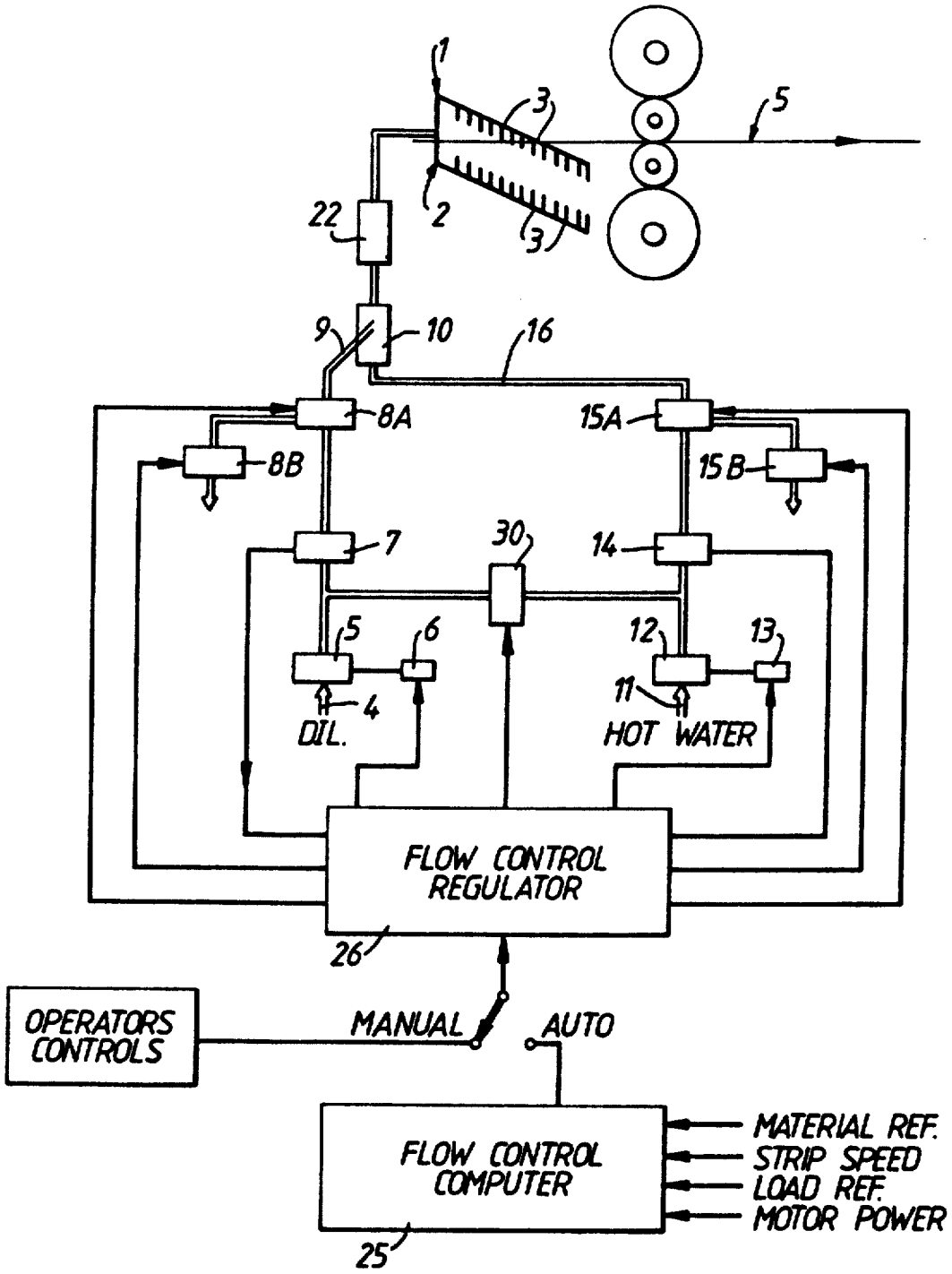

This invention relates to the cold rolling of metal strip and, in particular, to the application of liquid lubricant to the upper and lower surfaces of the strip immediately prior to rolling in a rolling mill.

It is known to spray a mixture of oil and water on to the upper and lower surfaces of steel strip just before it enters the gap between a pair of rolls to reduce the thickness of the strip. The oil and water mixture, in the form of an emulsion, serves to lower the friction between the strip surfaces and the surface of the roll barrels. Heretofore it has been the practice to supply substantially the same amount of lubricant to each surface of the strip at several of the stands in a multistand cold rolling mill and also the mixture supplied at each stand has consisted of the same proportions of oil and water. It has been found that this is not an efficient practice and that both the quantity of emulsion supplied and the proportions of water and oil in the emulsion need to be different for various rolling conditions.

It is known from US-A-4315421 for an oil-in-water emulsion to be pumped from an emulsion mixing tank to upper and lower manifolds where it is sprayed on to opposite surfaces of the strip being rolled. The oil and the water are supplied separately to the mixing tank where they are mixed together to form the emulsion.

According to a first aspect of the present invention, in a method of lubricating metal strip being rolled in a rolling mill, rolling oil flowing at a predetermined rate and water flowing at a predetermined rate enter into an emulsifier to be subjected to turbulence to produce an emulsion which is applied to the opposite surfaces of the strip prior to the strip being rolled; characterised in that the flow of rolling oil is introduced into the flow of water to cause at least partial mixing thereof prior to the oil and water entering the emulsifier.

According to a second aspect of the invention, apparatus for lubricating metal strip being rolled in a rolling mill comprises means for supplying rolling oil flowing at a predetermined rate and water flowing at a predetermined rate to an emulsifier where they are emulsified; and spray headers for applying the emulsion to the opposite faces of the strip immediately prior to the strip being rolled, characterised in the provision of means for introducing the flow of rolling oil into the flow of water to cause at least partial mixing thereof before entering the emulsifier.

When the mill comprises a multistand cold rolling mill, some or all of the stands have provision for supplying an emulsion of rolling oil and water to the upper and lower surfaces of the strip material immediately prior to it entering the stand and, at each of these stands, the quantity of oil and the quantity of water are individually controlled prior to the oil and water being mixed together and subsequently applied to the strip material.

The quantity of oil and the quantity of water may be determined in advance of rolling and then these quantities remain fixed during rolling or the quantities may be varied during rolling if the rolling parameters, such as strip speed and mill load, change during rolling. By varying the ratio of water and oil at one or more of the stands of a multistand rolling mill the rolling load pattern of the mill can be changed. These changes may be brought about manually by a mill operator or they may be under computer control.

As a result of this invention, at each stand where emulsion is supplied, the quantity of emulsion supplied to the strip material can be varied to give optimum results and, furthermore, the proportions of water and oil making up the emulsion can be changed to give the required lubricity. This results in satisfactory surface properties of the rolled strip and avoids wasting expensive lubricating oil.

Figure 2:
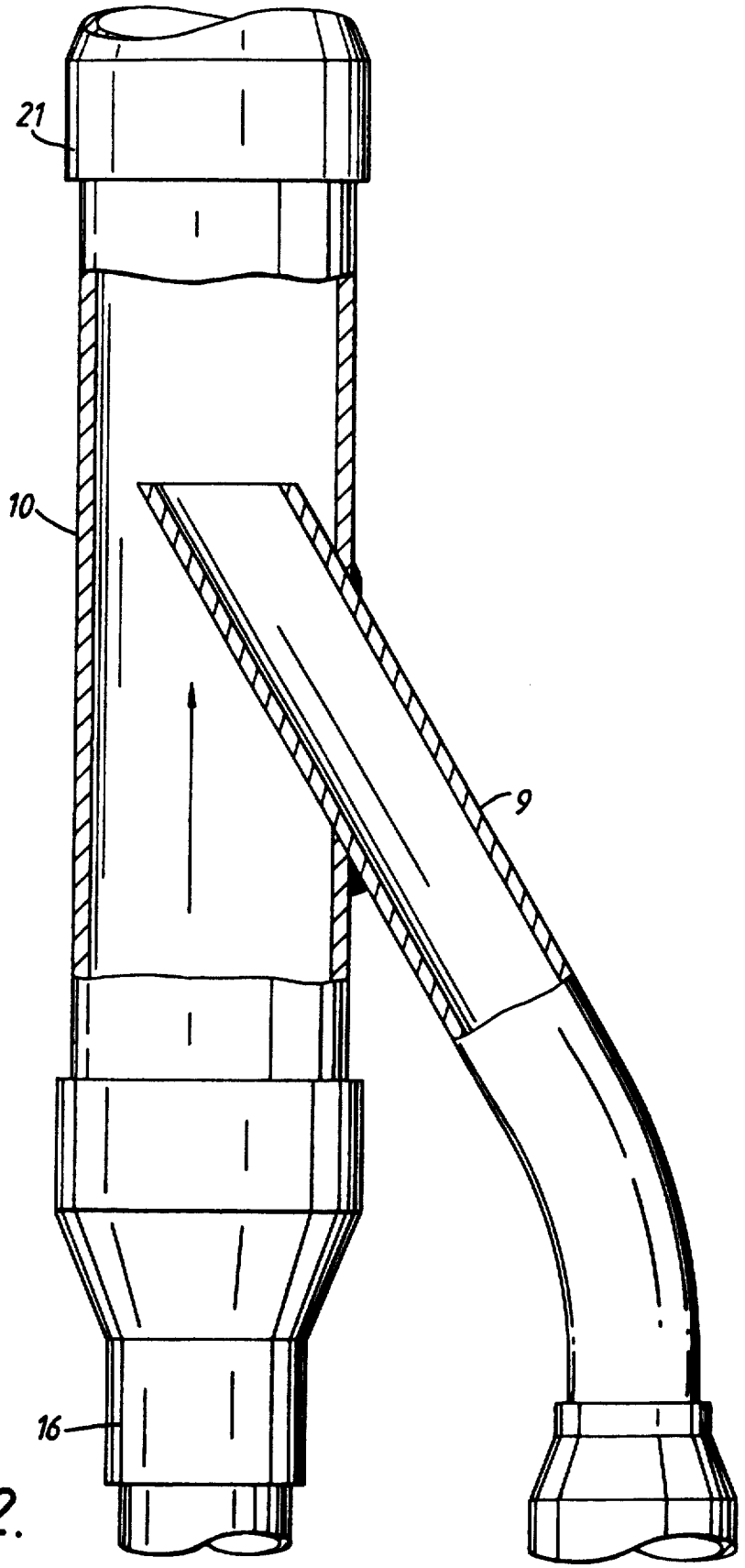

In order that the invention may be more readily understood, it will now be described, by way of example only, with reference to the accompanying drawings, in which:

FIG. 1 shows diagrammatically an arrangement for mixing the oil and water to form an emulsion which is applied to the strip at one stand of a multistand cold rolling mill; and FIG. 2 is a cross-section of a mixing tube shown in FIG. 1.

Referring to FIG. 1, a pair of headers 1, 2 are located immediately upstream of one of the stands of a cold rolling mill. Each header has a plurality of nozzles 3 spaced apart across the length of the mill rolls and the nozzles on header 1 direct liquid lubricant on to the upper surface of strip material S entering the mill stand and the nozzles on header 2 direct the lubricant on to the underside of the strip material.

The lubricant is an emulsion of neat rolling oil, such as palm oil, and hot water. The neat oil is pumped along a line 4 and the rate of flow of the oil is controlled by a valve 5. The valve can be adjusted by a controller 6 to vary the flow rate to required values. The flow rate is measured by a flowmeter 7. A valve 8A serves to divert the oil back to a storage tank (not shown), if necessary, but normally the oil is passed to the inlet oil pipe 9 of a mixing tube 10.

In a similar manner, the hot water is controlled. The water is pumped along a line 11 and the flow rate is controlled to a required level by a valve 12 adjusted by a controller 13. The flow rate is measured by a flowmeter 14 and a valve 15A serves to divert the hot water to tank, if necessary, through a valve 15B, otherwise the water enters the water inlet pipe 16 of the mixing tube 10.

As shown in FIG. 2, the mixing tube 10 has the water inlet tube 16 coaxial therewith at one end and an outlet tube 21 at the other end. The oil inlet tube 9 projects into the tube 10 at an angle of between 20–40 degrees, conveniently 30°, to the longitudinal axis of the tube 10 and extends into the tube 10 so that the longitudinal axis of the outlet end of the tube is substantially coincident with the axis of the tube 10. The cross-section of the tube 10 is greater than that of tube 9 so that there is space around the end of tube 9.

In use, the flow of oil entering the tube 10 from the tube 9 is drawn in and enters freely into the flow of water passing through the tube 10 even though the flow rate is considerably greater than that of the oil. From the mixing tube 10, the at least partially mixed water and oil passes into an emulsifier 22 where the mixture is subjected to turbulence to bring about thorough emulsification. The emulsion then passes to the headers 1, 2.

The mixed flow rate of emulsion per stand may be from 5–25 litres per minute, with the oil having a minimum flow rate of 0.23 lpm and a maximum flow rate of 12.5 lpm and the water a minimum flow rate of 2.5 lpm and a maximum flow rate of 23 lpm.

The supply of the lubricant to the strip material may be controlled manually by an operator but, preferably, it is under computer control.

A flow control computer 25 receives signals indicating such parameters as type of material being rolled, the speed of the strip material, the load on the rolling mill stand and the power of the driving motor. From this information, the computer controls a flow control regulator 26. The flow of oil from the valve 5 is measured by the flowmeter 7 and the regulator receives this information and adjusts the controller 6 to ensure that a measured flow of oil at the required rate enters the pipe 9. Similarly, the flow of water from the valve 12 is measured by the flowmeter 14 and the regulator receives this information and adjusts the controller 13 to ensure that a measured flow of water at the required rate enters the pipe 10. It will be appreciated that the regulator 26 can adjust the total quantity of oil and water supplied to the tubes 9, 10 and also the proportions of oil and water supplied to the tubes.

The computer 25 is programmed to control the flow rate of lubricant supplied to the strip material and also the ratio of oil and water in the emulsion. The correct computer control of the emulsion brings about a reduction in the consumption of rolling oil, a reduction in the rolling load on the mill stand with a resultant saving of energy and a reduction in the slippage in the roll bite.

An on-off flushing valve 30 controlled by the computer may be provided in a connecting pipe between the flow control valves 5 and 12. This permits hot water from line 11 to be used to flush out the system on completion of a rolling sequence.

Lubricant may be supplied to the strip material at a single stand mill or to each stand of a multistand mill or at only some of the stands.

It is essential that the measured flow of rolling oil enters into the pipe 10, otherwise the quantity of emulsion and the proportion of oil and water in the emulsion will be incorrect. The flow of the greater quantity of water around the outlet end of the oil feed tube 9 ensures that the oil is drawn into the water flow and at least partially mixes with it. The mixture from the mixing tube is thoroughly mixed to produce the emulsion in the emulsifier 22.

We claim:

1. Apparatus for lubricating metal strip being rolled in a rolling mill stand comprising a mixing tube structure comprising first and second tubes each having an inlet end and an outlet end, a portion of the second tube including the outlet end thereof projecting into a portion of the first tube intermediate its inlet and outlet ends with the outlet end of the second tube facing towards the outlet end of the first tube and said portion of the first tube being of greater cross-sectional area than the second tube;

means for supplying water to the inlet end of the first tube;

means for supplying oil to the inlet end of the second tube;

an emulsifier having an inlet and an outlet, the outlet end of the first tube being connected to the inlet of the emulsifier to supply an at least partial mixture of oil and water thereto;

and spray headers located at the inlet side of the rolling mill stand and connected to the outlet of the emulsifier to supply an oil-water emulsion from the emulsifier to metal strip entering the rolling mill stand.

2. Apparatus as claimed in claim 1 comprising means connected between the supply means and the inlet end of the first tube to adjust the flow of water to the first tube and means connected between the supply means and the inlet end of the second tube to adjust the flow of oil to the second tube.

3. Apparatus as claimed in claim 1, wherein the axis of the outlet of the second tube is inclined at an angle of between 20 and 40 degrees to the axis of the first tube.

4. Apparatus as claimed in claim 3, wherein the axis of the outlet of the second tube is inclined at 30 degrees to the axis of the first tube.

5. A multistand rolling mill for rolling metal strip and where at least some of the stands each has apparatus for lubricating metal being rolled in the stand as claimed in claim 1.

6. A method of lubricating metal strip being rolled in a rolling mill stand in which an oil-water emulsion is applied to the strip on the inlet side of the rolling mill, comprising the steps:

supplying water and oil to an inlet of a first tube and to an inlet of a second tube, respectively, where said first and second tubes each have an inlet end and outlet end, a portion of the second tube including the outlet end thereof projecting into a portion of the first tube intermediate its inlet and outlet ends with the outlet end of the second tube facing towards the outlet of greater cross-sectional area than the second tube, in order to form at least a partial mixture of oil and water;

supplying said at least partial mixture to an emulsifier to form an emulsion of oil and water; and applying said emulsion from said emulsifier to said strip.

7. A method as claimed in claim 6 wherein the flow of water is adjustable between 2.5 and 23 litres per minute.

8. A method as claimed in claim 6, wherein the flow of oil is introduced into the water flow at an angle of between 20 and 40 degrees relative to the direction of water flow.

9. A method as claimed in claim 8, wherein the flow of oil is introduced into the flow of water at an angle of 30 degrees.

10. A method as claimed in claim 6 wherein the flow of oil is adjustable between 0.23 and 12.5 litres per minute.

* * * * *

UNITED STATES PATENT AND TRADEMARK OFFICE

CERTIFICATE OF CORRECTION

PATENT NO. : 5,282,376

DATED : February 1, 1994

INVENTOR(S) : Steele et al.

It is certified that error appears in the above-indentified patent and that said Letters Patent is hereby corrected as shown below:

Column 4, lines 28-45, claim 6, should read

-- 6. A method of lubricating metal strip being rolled in a rolling mill stand in which an oil-water emulsion is applied to the strip on the inlet side of the rolling mill, comprising the steps:

supplying water and oil to an inlet of a first tube and to an inlet of a second tube, respectively, where said first and second tubes each have an inlet end and outlet end, a portion of the second tube including the outlet end thereof projecting into a portion of the first tube intermediate its inlet and outlet ends with the outlet end of the second tube facing towards the outlet end of the first tube and said portion of the first tube

UNITED STATES PATENT AND TRADEMARK OFFICE

CERTIFICATE OF CORRECTION

PATENT NO. : 5,282,376

DATED : February 1, 1994

INVENTOR(S) : Steele et al.

It is certified that error appears in the above-indentified patent and that said Letters Patent is hereby corrected as shown below:

being of greater cross-sectional area than the second tube, in order to form at least a partial mixture of oil and water;

supplying said at least partial mixture to an emulsifier to form an emulsion of oil and water; and applying said emulsion from said emulsifier to said strip. --

Signed and Sealed this

Twenty-fifth Day of August, 1998

Bruce Lehman

*Attest:*

BRUCE LEHMAN

*Commissioner of Patents and Trademarks*

*Attesting Officer*